US007263838B2

(12) United States Patent
Kirkconnell et al.

(10) Patent No.: US 7,263,838 B2
(45) Date of Patent: Sep. 4, 2007

(54) PULSE TUBE COOLER WITH INTERNAL MEMS FLOW CONTROLLER

(75) Inventors: Carl S. Kirkconnell, Huntington Beach, CA (US); Gerald R. Pruitt, San Pedro, CA (US); Kenneth D. Price, Long Beach, CA (US)

(73) Assignee: Raytheon Corporation, Waltham, MA (US)

( * ) Notice: Subject to any disclaimer, the term of this patent is extended or adjusted under 35 U.S.C. 154(b) by 393 days.

(21) Appl. No.: 10/974,154

(22) Filed: Oct. 27, 2004

(65) Prior Publication Data

US 2006/0086098 A1 Apr. 27, 2006

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS 5,642,623 A * 7/1997 Hiresaki et al. ..... 62/6
5,845,498 A * 12/1998 Matsui et al. ..... 62/6
6,256,998 B1 * 7/2001 Gao ..... 62/6
6,385,972 B1 * 5/2002 Fellows ..... 60/517
6,592,098 B2 * 7/2003 Kao et al. ..... 251/129.01
6,595,006 B2 * 7/2003 Thiesen et al. ..... 62/6
6,629,418 B1 * 10/2003 Gao et al. ..... 62/6
6,754,510 B2 * 6/2004 Hey-Shipton ..... 455/561
6,910,332 B2 * 6/2005 Fellows ..... 60/520
7,017,351 B2 * 3/2006 Hao et al. ..... 62/6
2003/0058515 A1 * 3/2003 Sanford ..... 359/233

* cited by examiner

*Primary Examiner*—William C Doerrler
(74) *Attorney, Agent, or Firm*—Leonard A. Alkov

(57) ABSTRACT

A regenerative refrigeration system includes one or more control devices that utilize micro electro mechanical systems (MEMS) technology. Such MEMS devices may be small in size, on a scale such that it can be introduced into a refrigeration system, such as a cryocooler, without appreciably affecting the size or mass of the refrigeration system. Through the use of MEMS devices, dynamic control of the system may be achieved without need for disassembly of the system or making the system bulky. Suitable regenerative refrigeration systems for use with the MEMS devices include pulse tube coolers, Stirling coolers, and Gifford-McMahon coolers.

22 Claims, 3 Drawing Sheets

PULSE TUBE COOLER WITH INTERNAL MEMS FLOW CONTROLLER

BACKGROUND OF THE INVENTION

1. Technical Field of the Invention

This invention is in the field of cryocoolers, and more particularly in the field of pulse tube coolers.

2. Description of the Related Art

Present pulse tube technology relies on flow control that is achieved using fixed geometry, e.g., fixed flow restrictor orifices, or long, small diameter flow lines ("inertance tubes"). Either approach relies on setting or selecting the flow restriction prior to operation of the pulse tube expander. A change in flow restriction requires some degree of physical disassembly of the expander for access to the restrictor. Neither approach lends itself to dynamic control of the flow restriction. Optimization of designs requiring empirical support, by nature of these limitations, may be extremely tedious. A lack of dynamic control also restricts optimization for a specific operating regime, e.g., maximum cooling capacity for fast cool down or peak operating efficiency for steady state power conservation.

Prior attempts to obtain set point adjustment without disassembly have included use of adjustable metering valves, which are large and may be impractical for systems outside of laboratories. Another attempt has been use of crimpable flow control tubes. These systems have the drawback of providing only crude adjustment, and changes cannot be reversed once made. Neither of these approaches provides dynamic flow control, that is, flow control synchronized with operating speed of the system.

Another prior attempt at providing adjustable control in a pulse tube cooler has been to add a piston to the warm end of the pulse tube. This requires an additional motor-piston assembly, which increases size, mass, complexity, and cost of the system, and may reduce system reliability.

As will be understood from the foregoing, it will be seen that there is room for improvement in control systems for pulse tube coolers.

SUMMARY OF THE INVENTION

According to an aspect of the invention, a regenerative refrigerator includes: a compressor; a regenerator coupled to a downstream end of the compressor; a pulse tube coupled to a downstream end of the regenerator; and a MEMS flow controller for controlling flow within the refrigerator.

According to another aspect of the invention, a method of operating a regenerative refrigerator, includes the steps of: cyclically operating a compressor of the refrigerator, to cause cyclic flow through a regenerator and a pulse tube that are coupled to the compressor; and adjusting at least one MEMS flow controller of the refrigerator to adjust mass flow at at least one location within the regenerative refrigerator.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

A regenerative refrigeration system includes one or more control devices that utilize micro electro mechanical systems (MEMS) technology. Such MEMS devices may be small in size, on a scale such that it can be introduced into a refrigeration system, such as a cryocooler, without appreciably affecting the size or mass of the refrigeration system. Through the use of MEMS devices, dynamic control of the system may be achieved without need for disassembly of the system or making the system bulky. Suitable regenerative refrigeration systems for use with the MEMS devices include pulse tube coolers, Stirling coolers, and Gifford-McMahon coolers.

Figure 1:
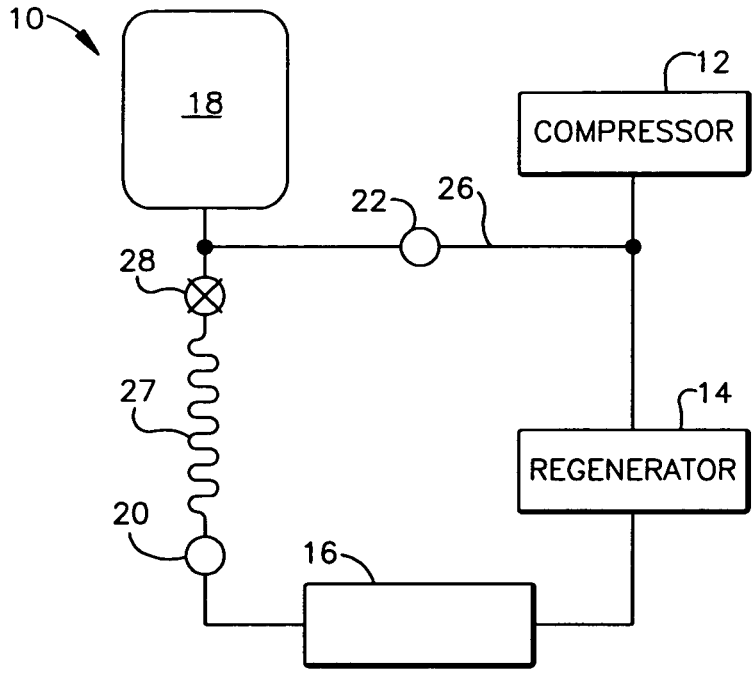
FIG. 1 is a schematic view of a generalized cooler or refrigeration system, with MEMS flow controllers, in accordance with the present invention.

FIG. 1 illustrates a generalized regenerative refrigerator or cooler system 10. The cooling system 10 includes a compressor 12, a regenerator 14, a pulse tube 16, and a surge volume 18. The compressor 12 is referred to herein as at the upstream end of the system, and the surge volume 18 is referred to as at the downstream end of the system 10. Thus the downstream end of the compressor 12 is connected to the upstream end of the regenerator 14, the downstream end of the regenerator is connected to the upstream end of the pulse tube 16, and so forth.

The system 10 includes a pair of MEMS flow controllers or devices 20 and 22, for controlling flow within the system 10. One of the MEMS devices 20 is between the pulse tube 16 and the surge volume 18. The other MEMS flow controller 22 is in a bypass line 26 that allows flow from the outlet (downstream end) of the compressor 12 to bypass the regenerator 14 and the pulse tube 16.

The cooler 10 may have additional components such as an inertance tube 27 or an orifice 28 coupled to the pulse tube 16. The inertance tube 27 or the orifice 28 may aid in providing proper phase in the pulse tube 16.

The terms "MEMS device" and "MEMS flow controller," as used herein, refer to micro-miniature flow controllers that are fabricated using micro electro mechanical systems (MEMS) technology. MEMS technology is a term used to describe manufacturing processes employed to produce devices with characteristic dimensions of nominally 1 to 10 microns. The most common MEMS fabrication technique is to utilize deep reactive ion etch (DRIE) processing to produce the desired structure in or from a silicon substrate. Metal deposition techniques (sputtering or vapor deposition) are used to apply required metallization layers. Such metallization may be required, for instance, to carry current or serve as electrodes, or act as intermediate layers to improve the adhesion of subsequent layers. Using such techniques, one can achieve structures with the required electrical and mechanical characteristics at the device scale required for use in the cooling systems described herein. Materials other than silicon or metallics may be incorporated in intermediate processing steps to achieve desired characteristics (insulation, capacitance, resistance) of the overall MEMS structure.

It will be appreciated that integrated actuation and control techniques for such MEMS devices may be limited to those that can be applied at the micron scale. Typical actuation techniques include electrostatic, piezoelectric, electromagnetic, and thermal. Any suitable actuation technique may be utilized which is able to provide suitable flow rate, dynamic response, power efficiency, and/or other operating characteristics for MEMS devices or flow controllers. The requirements for such MEMS devices may vary widely depending on their location and use, so it is anticipated that different requirements will be met with different actuation techniques, as well as with different physical designs. For situations where dynamic control is desired, MEMS devices may be configured to operate within small periods of time, such that their dynamic response is much faster than the operating speed of the cooling system. For example, MEMS devices acting as the primary phase shifter 20 may have a response rate an order of magnitude faster than the frequency of the compressor 12, which may be a typical operating frequency such as 30 Hz or 60 Hz.

The MEMS devices utilized herein may be considered as orifice or valve systems. Each such system contains one or more flow passages with active control. Active control may enable adjustment from closed to fully open, or over some smaller range. Each flow passage of a MEMS flow controller may have a characteristic dimension on the order of 1 mm. This invention improves in a number of aspects upon previous attempts to achieve active control (using macro systems): 1) overall size of the controller is not adversely impacted by introducing MEMS flow controllers; 2) MEMS flow controllers have minimal void volume; and 3) the small physical structures of MEMS flow controllers enable rapid dynamic response.

In operating a regenerative refrigeration system, it is desirable to get the mass flow rate of the system in proper phase with the pressure wave (generated by the compressor 12) at various locations within the system 10. In such systems it is desirable to create expansion work where it is desired that the system be cold, and to put in compression work where power is being put into the system. Instead of the passive means currently used to get pulse tubes into proper phase relationships, the MEMS devices disclosed herein allow active flow control of flow within the pulse tube 16. In addition, the active control allows remote adjustments to be made in the operation of the system 10. For example, changes in operation may be made by sending communication signals over long distances (without direct physical contact with the system 10), for example to an orbiting spacecraft, to change the amount of current or otherwise actuate changes in a MEMS controller.

The cooling/refrigeration system 10 shown in FIG. 1 is intended to be representative of a wide variety of regenerative refrigeration systems for which MEMS flow controllers or devices may be utilized. The regenerative refrigeration system 10 may be a system that operates on a modified Stirling thermodynamic cycle (a Stirling pulse tube). Alternatively the regenerative refrigeration system may be a system that operates on a modified Ericson thermodynamic cycle, what is often referred to as a Gifford-McMahon pulse tube system. It will be appreciated that some such systems may not utilize all of the components shown in the example system of FIG. 1. For example, some systems may omit the surge volume 18, and/or may not utilize the bypass line 26. As another alternative, the cooling system 10 may have multiple bypass lines between various locations of the regenerator 14 and respective locations of the pulse tube 16.

Further, it will be appreciated that the locations of the MEMS flow controllers 20 and 22 in the system 10 are merely examples of possible locations of MEMS flow controllers. The system 10 may alternatively utilize only a single flow controller, such as the MEMS flow controller 20 between the pulse tube 16 and the surge volume 18. As another alternative, the system 10 may employ additional MEMS flow controllers, at different locations.

Figure 2:
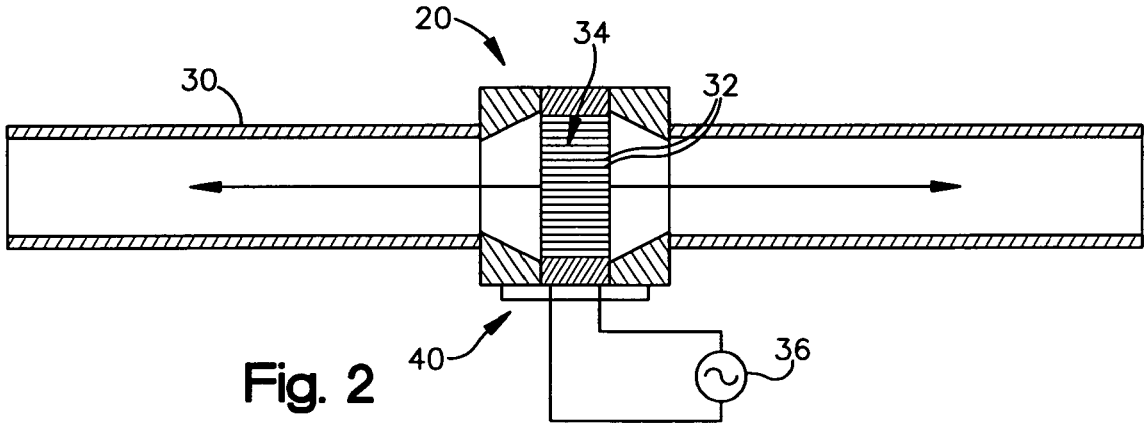
FIG. 2 is a schematic diagram of a MEMS flow controller for use with the cooler of FIG. 1.

FIG. 2 illustrates an example of details of the MEMS flow controller 20, which may be representative of a typical MEMS flow controller. The MEMS flow controller 20 is located in a flow passage 30 and controls flow within the flow passage 30. The MEMS device 20 has a plurality of flow passages 32 within a piezoelectric material 34. The piezoelectric material may be a suitable material with an asymmetric crystalline structure. Deformation of the piezoelectric material may be controlled by applying current from an AC current source 36. The current source 36 is coupled to the piezoelectric material through a hermetic electrical feedthrough 40. By applying different amounts of current to the piezoelectric material 34 the piezoelectric material 34 may be deformed, changing the size and/or the shape of the flow passages 32. The flow passages 32 may be controlled as a group or individually, depending upon how the drive circuit is configured. The current source 36 may be one of multiple such current sources, for example, controlling deformation of different parts of the piezoelectric material 34. Thus a wide range of control of flow through the MEMS flow controller 20 may be rapidly accomplished, simply by controlling the input current.

Use of a MEMS device or flow controller, such as the MEMS device 20 within the regenerative refrigeration system 10, allows many advantages in controlling operation of the cooler refrigeration system 10. Since only electrical signals may be needed as an input to reconfigure the MEMS device 20, remote control of the device may be possible. Remote control is defined herein as control that does not involve physical contact with the system 10 (such as through knobs, levers, wires, switches, etc.) to change operation of the system 10. Remote control of the flow characteristics of a flow restrictor, such as the MEMS device 20, results in more flexibility in achieving characteristics of the MEMS flow controller, and in more efficient evaluation of flow restrictor designs. Because the MEMS flow controller 20 is electronically actuated, changes to flow characteristics can be accomplished without need for mechanical disassembly/re-assembly of the system 10. Engineering characterization testing that would typically require one or two days for each operational data point may be accomplished within one or two hours, through use of the MEMS flow controller 20. Full characterization testing that might require weeks or months of test time in prior systems may be accomplished within days in a refrigeration system utilizing MEMS flow controllers.

Another advantage is that MEMS flow controllers utilize minimal parasitic void volume. Excess void volume decreases system efficiency by forcing pressure cycling of additional volume that does not contribute to creating refrigeration.

Further, remote control of flow characteristics of the MEMS flow controller or restrictor permits dynamic optimization of restrictor or flow controller performance as a function of operating conditions. Flow characteristics of the MEMS flow controller 20/22 may be controllable during an individual cycle of the system, which is typically run at 30-60 Hz. The configuration of the one or more MEMS devices 20 and 22 may be tailored for optimum performance, and matched to operating conditions throughout each individual cycle. The flow characteristics may be optimized as a function of operating temperature (ambient to cryogenic during the cool-down transition) or applied heat lift (variable thermal loading at steady-state cryogenic temperature). Dynamic response of the MEMS flow controllers 20 and 22 allows the flexibility of real time tailoring of flow into and out of the pulse tube 16. The result may be a control of pressure wave forms and phase relationships that impact overall effectiveness of the pulse tube 16. Through use of MEMS flow controllers, reduction may be achieved in undesirable imbalance forces associated with pressure fluctuations. This enhanced controllability of the pulse tube 16 within the refrigeration system 10 offers a dimension of pulse tube cryocooler control that is not available in prior systems.

Figure 3:
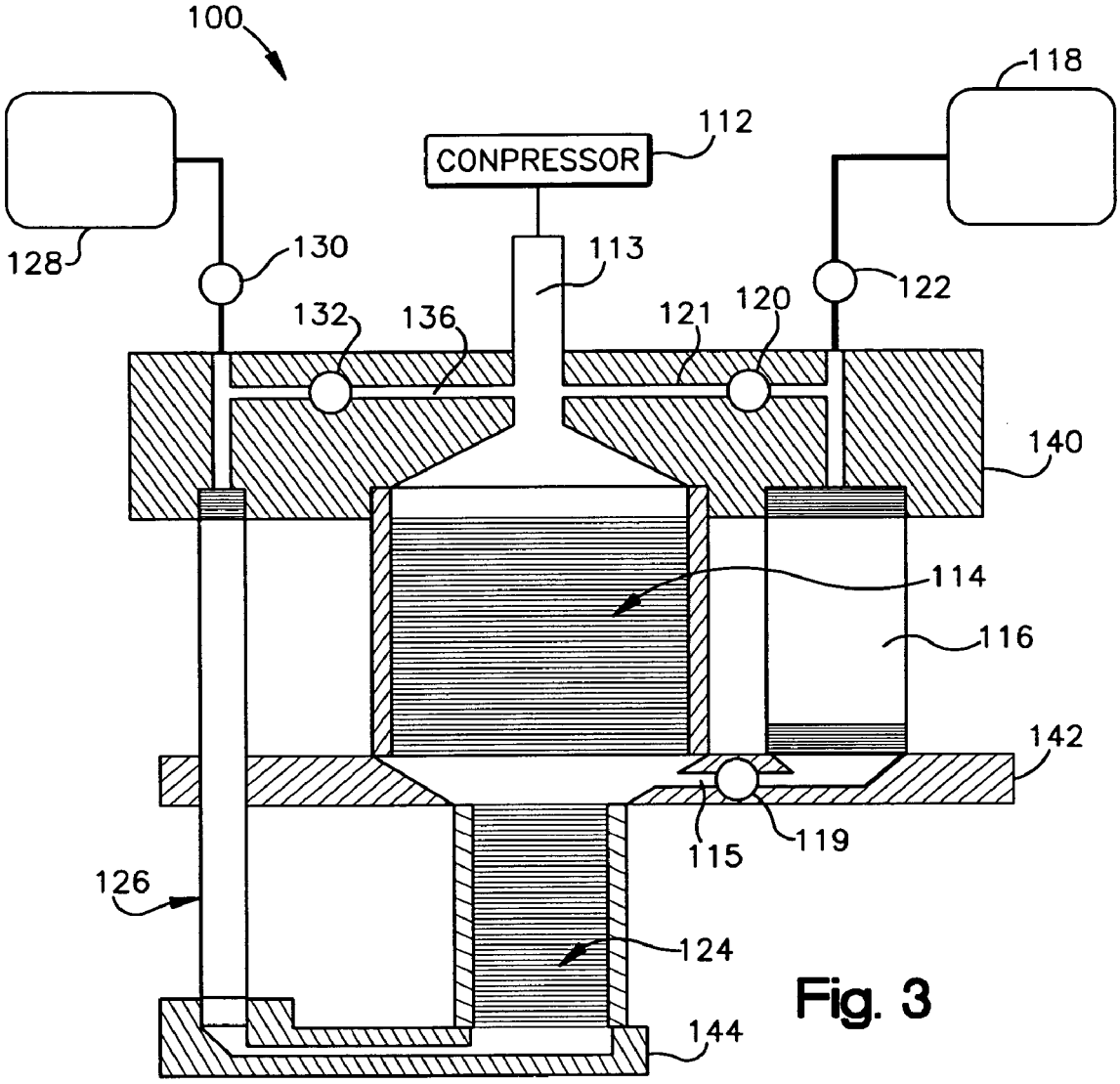
FIG. 3 is a schematic diagram of a two-stage pulse tube cooler, with MEMS flow controllers, in accordance with the present invention.

FIG. 3 illustrates a two-stage pulse tube cooler 100 that utilizes MEMS devices. The cooling system 100 includes a compressor 112 that is coupled via a transfer line 113 to a first stage regenerator 114. A first stage flow shunt 115 couples outflow from the first stage regenerator 114 to the inlet of a first stage pulse tube 116. The first stage pulse tube 116 is coupled at its downstream end to a first surge volume 118. A shunt MEMS device 119 may be located in the first stage flow shunt 115 at an upstream end of the first stage regenerator 114. Another possibility is a MEMS device 120 located in a bypass line 121 at a downstream end of the fist stage regenerator 114. Alternatively, or in addition, a first stage MEMS device 122 may be located between the first stage pulse tube 116 and the surge volume 118.

The outlet (downstream end) of the first stage regenerator 114 is coupled to a second stage regenerator 124, which is in turn coupled to a second stage pulse tube 126. The second stage pulse tube 126 is coupled to a second surge volume 128. A second stage MEMS flow controller 130 may be located in the line between the second stage pulse tube 126 and the surge volume 128. Alternatively or in addition a bypass MEMS flow controller 132 may be located in a bypass line 136 between the transfer 113 and the surge volume 128.

The cooling system 100 provides two stages of cooling. An ambient temperature region 140 is upstream of the first stage regenerator 114, and downstream of the pulse tubes 116 and 126. A first cold stage 142 is located downstream of the first stage regenerator 114, and at the upstream side of the first stage pulse tube 116. A second cold stage 144, at a lower temperature than the first cold stage 142, is located at the downstream end of the second stage regenerator 124, and the upstream end of the second stage pulse tube 126.

The MEMS flow controllers 120, 122, 130 and/or 132 may be used to dynamically control operation of the cooling system 100. It will be appreciated that not all of the MEMS flow controllers shown in FIG. 3 need be used in the system. In fact, it is possible that a system may utilize only a single MEMS flow controller. In addition, it will be appreciated that different of the flow controllers 120, 122, 130, and 132, may have different functions. The flow controllers 122 and 130 may be utilized as the primary way of shifting phase within the respective pulse tubes 116 and 126. The flow controllers 122 and 130 allow control of the motion of the gas in the pulse tubes 116 and 126, which controls the phase angle between movement of the gas or the mass flow rate, and the expansion that occurs in both the first and second stages (at the locations 142 and 144), to create refrigeration.

The shunt MEMS flow controller 120 may be used to bias the flow one way or another, either to the first stage pulse tube 116 or to the second stage pulse tube 126, for instance, to meet different operating points or even to meet duty cycle loads. Thus the MEMS flow controller 120 may be used to control the relative cooling at the first stage portion 142 and the second stage portion 144.

The bypass MEMS flow controller 132 controls movement of gas through the bypass line 136. Such bypass lines have been shown to improve performance of the second stage by controlling motion of the gas column without forcing all the gas to go all the way through the regenerators 114 and 124. Losses generated by passing the gas through the regenerators 114 and 124 may thus be reduced. Previous attempts using traditional, fixed bypass geometries have been shown to give rise to a net mass flow rate across the bypass when one considers the integrated, cyclical mass flow rate. This usually manifests as a flow from the compressor end to the surge volume in a single-stage pulse tube refrigerator, but such a "DC flow" in either direction is deleterious to performance. By controlling flow through the bypass line 136, through action of the bypass MEMS flow controller 132, undesired movement of gas from the bypass tube 136 to the downstream end of the second stage pulse tube 126, may be avoided. Such backflows from the bypass tube 136 to the second stage pulse tube 126 (and back through the regenerators 114 and 124 as well) involve losses due to the movement of hot gasses to the cold stages 142 and 144. These losses may be reduced or avoided by suitably setting the bypass MEMS flow controller 132.

Figure 4:
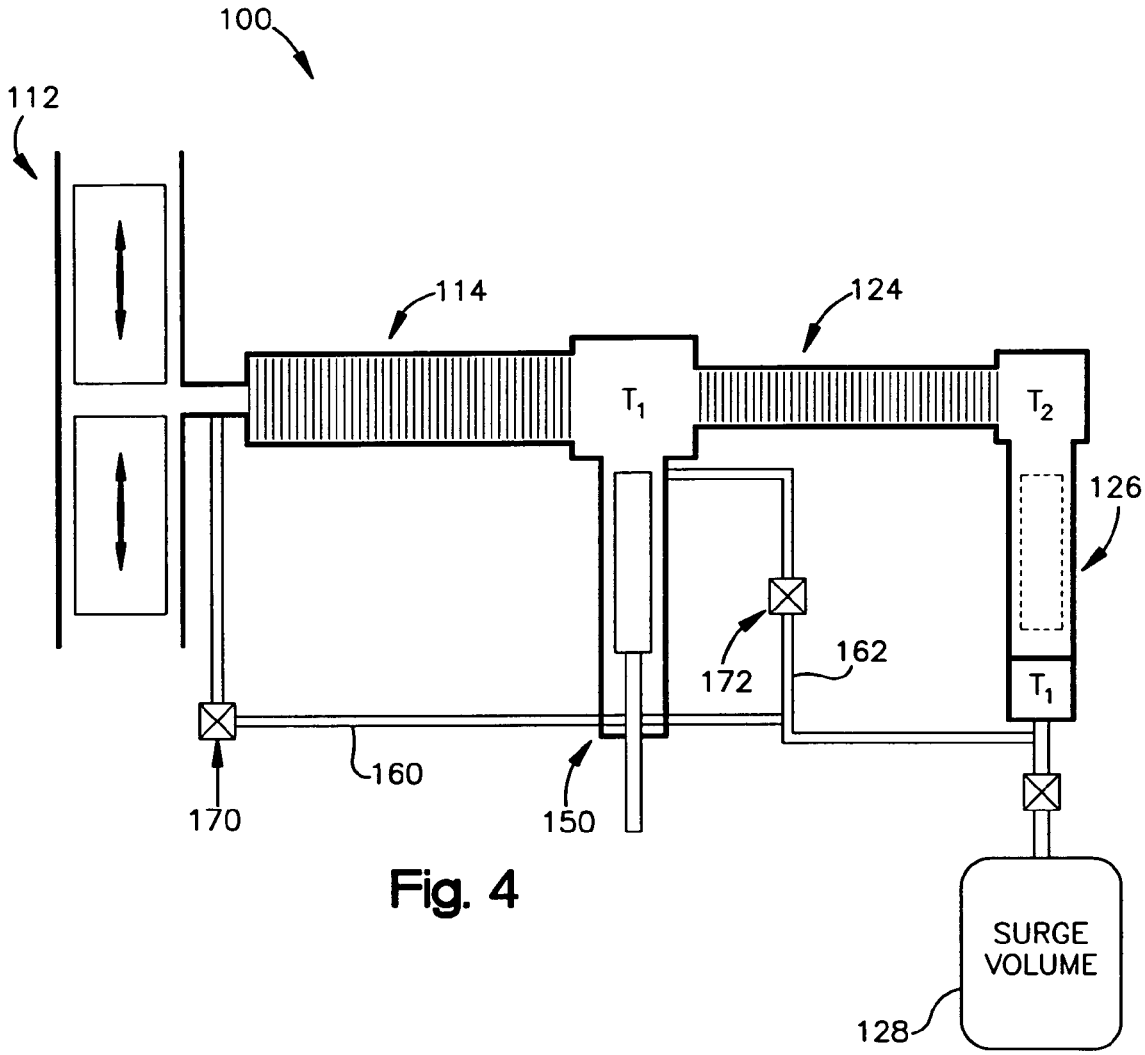
FIG. 4 is a schematic diagram of a multi-stage Stirling/pulse tube hybrid cooler, with a MEMS flow controller, in accordance with the present invention.

FIG. 4 shows a Stirling/pulse tube hybrid cooler 100', with MEMS flow controllers. The hybrid cooler 100' includes a compressor 112, and a Stirling expander 150 between the first stage regenerator 114 and the second stage regenerator 124. The second stage regenerator 124 is coupled to the second stage pulse tube 126. Between the second stage pulse tube 126 and the surge volume 128 is a second stage MEMS controller 130, which may be configured to set (shift) the phase within the second stage pulse tube 126. In addition, the cooler 100' may have bypass lines 160 and 162 linking the surge volume 128 to the upstream ends of the regenerators 114 and 124, respectively. The bypass lines 160 and 162 may have respective MEMS flow controllers 170 and 172. Further details regarding Stirling/pulse tube hybrid coolers may be found in U.S. Pat. Nos. 6,167,707 and 6,330,800, the entire disclosures of which are herein incorporated by reference in their entireties.

It will be appreciated that the specific examples of cryocoolers show in the Figures and discussed above are but a few examples of possible ways of employing MEMS devices or flow controllers within regenerative refrigeration systems. In addition, it will be appreciated that various functions may be had for the various MEMS flow controllers described herein, including set point control (controlling the set point of the system), and dynamic flow control.

What follows now are several examples of operating conditions for systems utilizing MEMS flow controllers. The examples are given with respect to a pulse tube cryocooler operating in a helium environment, with 20-45 atmospheres working pressure, operating under oscillating flows with no volatile materials, to be operated under a system with a long life (10-year life) and high reliability.

EXAMPLE 1

The MEMS flow controller operates as an ambient temperature, adjustable set point flow controller. One side of the MEMS flow controller/valve will be connected to a large pressure ballast (surge volume), making that side essentially isobaric. The other side will see an oscillating pressure wave. The use of the MEMS flow device in this example is as a primary phase shifter, or as a secondary "trim" phase shifter, for a pulse tube with a warm end ambient temperature. Basic requirements of the system are a warm end operating temperature of 250K to 320K; a pressure wave amplitude of 1.2 to 1.5 ($P_{max}/P_{min}$); a nominal flow conductance of 0.01 to 0.05 (g/s)/atm; an adjustability of greater than ±25% of selected nominal flow conductance set point; a minimal void volume introduced on the side of the MEMS flow controller that sees the oscillating pressure wave (<0.2 cc, as an approximate); and a power of less than about 1 watt to set and maintain set point.

EXAMPLE 2

The MEMS flow control device is an ambient temperature, adjustable set point flow controller, with controllable bias. One side of the MEMS flow controller will be connected to a large pressure ballast (surge volume), making it essentially isobaric. The other side will see an oscillating pressure wave. The bias of the MEMS flow controller (i.e., its flow in opposite directions) is also remotely controllable. The MEMS flow controller functions as a primary phase shifter or as a secondary "trim" phase shifter for a pressure tube with a warm end ambient temperature. The controllable bias provides an additional degree of control over the configuration in Example 1. The basic requirements for the system are a warm end operating temperature of 250K to 320K; a pressure wave amplitude of 1.2 to 1.5 ($P_{max}/P_{min}$); a nominal flow conductance of 0.01 to 0.05 (g/s)/atm; an adjustability of greater than ±25% of selected nominal flow conductance set point; a bias of greater than ±10%; a minimal void volume introduced on the side of the MEMS flow controller that sees the oscillating pressure wave (<0.2 cc, as an approximate); and a power of less than about 1 watt to set and maintain set point and bias.

EXAMPLE 3

The MEMS flow controller functions as an ambient temperature, dynamic flow controller, with adjustment to allow it to be synchronized with the operating frequency of the cooling system. As in Examples 1 and 2, one side of the flow controller will be essentially isobaric while the other will see an operating pressure wave. The MEMS device may be either a single device, or a simple combination of various valves/devices. The dynamic flow control provides an additional degree of control over that achieved in Examples 1 and 2. The basic requirements of the system are a warm end operating temperature of 250K to 320K; a pressure wave amplitude of 1.2 to 1.5 ($P_{max}/P_{min}$); a nominal flow conductance of 0.01 to 0.05 (g/s)/atm; an adjustability of greater than ±25% of selected nominal flow conductance set point, with an adjustability of 100% desirable (this type of adjustability automatically provides bias capability); a minimal void volume introduced on the side of the MEMS flow controller that sees the oscillating pressure wave (<0.2 cc, as an approximate); a power of less than about 1 watt to set and maintain set point; and operating frequency >1 kHz (0.999 dynamic response in 0.001 seconds).

EXAMPLE 4

The MEMS flow device is used as a cryogenic temperature, adjustable set point flow controller, allowing remote adjustment. As with the examples above, one side of the flow controller is essentially isobaric and the other side sees an oscillating pressure wave. There may be a requirement for the device to be compact, because it is located in a cryogenic region. The use of the MEMS flow device may be as a primary phase shifter or secondary "trim" phase shifter for a pulse tube with its "warm end" at cryogenic temperature, as might be found in the colder stage or stages of a multistage pulse tube or hybrid Stirling/pulse tube cooler. The basic requirements of the system are an operating temperature of 20K to 150K; a pressure wave amplitude of 1.2 to 1.5 ($P_{max}/P_{min}$); a nominal flow conductance of 0.01 to 0.05 (g/s)/atm; an adjustability of greater than ±25% of selected nominal flow conductance set point; a minimal void volume introduced on the side of the MEMS flow controller that sees the oscillating pressure wave (<0.2 cc, as an approximate); and a power of less than about 0.3 watt to set and maintain set point.

EXAMPLE 5

The MEMS flow device is used as a cryogenic temperature, adjustable set point flow controller with controllable bias, allowing for remote adjustment. The conditions for this example are the same as for Example 2, with the exceptions that the operating temperature is 20K to 150K, and the power is less than about 0.3 watts to set and maintain set point and bias.

EXAMPLE 6

The MEMS flow device is a cryogenic temperature, dynamic flow controller that allows remote adjustment, and is synchronized with the operating frequency of the system. The conditions for this example are the same as for Example 3 (described above), with the exception that the operating temperature is 20K to 150K, and the power is less than about 0.3 W to set and maintain the set point.

EXAMPLE 7

The MEMS flow device is used as ambient bypass flow controller, to allow direct porting of working gas from one portion of the cooler to another, such as is required for the "double-inlet" pulse tube configuration. In this application, both sides of the MEMS flow controller see an oscillating pressure wave, albeit of different amplitude and phase. The functionality of the MEMS flow device may be achieved by either a single flow controller, or by a simple combination of flow controllers. Controllability of the flow bias may be important for this application. The use of the MEMS flow device is to allow flow bypass from an expander inlet to a pulse tube warm end, to decrease regenerator loss, and in doing so to increase refrigeration capacity. Basic requirements of the system are a warm end operating temperature of 250K to 320K; a pressure wave amplitude of 1.2 to 1.5 ($P_{max}/P_{min}$); a nominal flow conductance of 0.005 to 0.01 (g/s)/atm; an adjustability of greater than ±25% of selected nominal flow conductance set point, with an adjustability of 100% desirable (this type of adjustability automatically provides bias capability); a bias of greater than ±10%; minimal void volume on both sides of the valve; and a power of less than about 1 watt to set and maintain set point and bias.

EXAMPLE 8

The MEMS flow device is used as a cryogenic bypass flow controller. The basic requirements of the system are the same as in Example 7, with the exceptions that the warm end operating temperature is 20K to 150K, and the power is less than about 0.3 watts to set and maintain set point and bias.

EXAMPLE 9

The MEMS flow controller is used as a dynamic bypass flow controller. The basic system requirements are the same as in Example 7, with the additional requirement that the dynamic response be greater than about 1 kHz.

EXAMPLE 10

The MEMS flow controller is used as a dynamic, cryogenic bypass flow controller. The basic requirements are the same as in Example 7, with the warm end operating temperature being 20K to 150K, the power is less than about 0.3 watts to set and maintain set point and bias, and with the additional requirement that the dynamic response is greater than about 1 kHz.

The present invention thus involves using MEMS flow controllers to control flow inside a pulse tube refrigerator. Such MEMS devices may function as a re-configurable orifice, with the amount of flow restriction being controlled by an input signal. Such a device may be set remotely, where physical contact with refrigerator is impractical of impossible. MEMS flow controllers may function within the refrigerator in any of the following ways: as a primary phase shifter; as a secondary phase shifter (for example, in addition to an orifice, an inertance tube, etc.); to control flow in a bypass line (for instance, in a "double-inlet" pulse tube); or as a flow splitter to regular flow allocation between stages in a multi-stage cooler or refrigerator.

It will be appreciated that various components described with regard to one of the embodiments may be employed, where suitable, with other of the embodiment coolers.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A regenerative refrigerator comprising:

a compressor;

a regenerator coupled to a downstream end of the compressor;

a pulse tube coupled to a downstream end of the regenerator; and a MEMS flow controller for controlling flow within the refrigerator.

2. The refrigerator of claim 1, wherein the MEMS flow controller functions as a phase shifter to control phase within the pulse tube.

3. The refrigerator of claim 2, further comprising a surge volume coupled to a downstream end of the pulse tube; and wherein the MEMS flow controller is between the pulse tube and the surge volume.

4. The refrigerator of claim 1, further comprising:

a surge volume coupled to a downstream end, of the pulse tube; and a bypass line coupling the upstream end of the regenerator to the downstream end of the pulse tube;

wherein the MEMS flow controller is in the bypass line.

5. The refrigerator of claim 1, wherein the refrigerator is a multistage refrigerator, with the regenerator being a first stage regenerator and the pulse tube being a first stage pulse tube; and further comprising:

a first surge volume coupled to a downstream end of the first stage pulse tube;

a second stage regenerator coupled to the downstream end of the first stage regenerator;

a second stage pulse tube coupled to a downstream end of the second stage regenerator; and a second surge volume coupled to a downstream end of the second stage pulse tube.

6. The refrigerator of claim 5, wherein the MEMS flow controller is between the one of the pulse tubes and the surge volume coupled to that pulse tube.

7. The refrigerator of claim 6, further comprising another MEMS flow controller between the other pulse tube and the other surge volume.

8. The refrigerator of claim 5, wherein the MEMS flow controller is between the downstream end of the first stage regenerator and an upstream end of the first stage pulse tube, thereby controlling allocation between stages of the refrigerator.

9. The refrigerator of claim 5, further comprising a bypass line coupling together a downstream end of the first stage regenerator, and the downstream end of the second stage pulse tube; and wherein the MEMS flow controller is in the bypass line.

10. The refrigerator of claim 6, further comprising a bypass line coupling together an upstream end of the first stage regenerator, and the downstream end of the second stage pulse tube; and wherein the MEMS flow controller is in the bypass line.

11. The refrigerator of claim 1, wherein the MEMS flow controller is an adjustable flow restrictor.

12. The refrigerator of claim 11, wherein the flow restrictor is a biased flow restrictor that is biased, having greater flow restriction in one direction than in an opposite direction.

13. The refrigerator of claim 1, wherein the MEMS flow controller provides dynamic flow control for the refrigerator, adjusting flow within a single cycle of the compressor.

14. The refrigerator of claim 13, wherein the MEMS flow controller has a response time less than about 1/60 of a second.

15. A method of operating a regenerative refrigerator, the method comprising:

cyclically operating a compressor of the refrigerator, to cause cyclic flow through a regenerator and a pulse tube that are coupled to the compressor; and adjusting at least one MEMS flow controller of the refrigerator to adjust mass flow in at least one location within the refrigerator.

16. The method of claim 15, wherein the adjusting includes dynamically adjusting the at least one MEMS flow controller at a rate at least as fast as a cyclic rate of the compressor.

17. The method of claim 15, wherein the refrigerator is a multi-stage refrigerator; and wherein the adjusting the MEMS flow controller includes adjusting relative mass flow between stages of the refrigerator.

18. The method of claim 15, wherein the refrigerator includes a surge volume coupled to the pulse tube;

wherein the at least one MEMS flow continuer includes a MEMS flow controller between the surge volume and the pulse tube; and wherein the adjusting includes adjusting flow restriction between the surge volume and the pulse tube.

19. The method of claim 15, wherein the refrigerator includes a surge volume coupled to the pulse tube; and wherein the adjusting includes adjusting flow restriction in a bypass line coupling an upstream end of the regenerator to the surge volume.

20. The method of claim 15, wherein the refrigerator includes a surge volume coupled to the pulse tube; and wherein the adjusting includes adjusting flow restriction in a bypass line coupling a downstream end of the regenerator to the surge volume.

21. The method of claim 15, wherein the adjusting includes remotely adjusting the at least one MEMS flow controller by use of a signal sent from a device not in contact with the refrigerator.

22. The method of claim 15, wherein the adjusting includes changing a set point of the refrigerator without any degree of disassembly of the refrigerator.

* * * * *